US008096212B2

(12) United States Patent
Su

(10) Patent No.: US 8,096,212 B2
(45) Date of Patent: Jan. 17, 2012

(54) TWO-SECTION TOOL JOINT

(76) Inventor: Cheng-Wei Su, Taichung (TW)

( * ) Notice: Subject to any disclaimer, the term of this patent is extended or adjusted under 35 U.S.C. 154(b) by 148 days.

(21) Appl. No.: 12/578,397

(22) Filed: Oct. 13, 2009

(65) Prior Publication Data

US 2011/0083535 A1 Apr. 14, 2011

(51) Int. Cl.
*B25B 23/00* (2006.01)
*B25G 3/38* (2006.01)

(52) U.S. Cl. ..... 81/177.75; 403/135; 464/159; 81/177.85

(58) Field of Classification Search ..... 081/177.75, 081/177.85, 450; 464/89–91, 159; 403/132, 403/134, 135
See application file for complete search history.

(56) References Cited

U.S. PATENT DOCUMENTS

| | | | | | |
|---|---|---|---|---|---|
| 61,581 | A * | 1/1867 | Taylor | ..... | 81/177.75 |
| 4,318,627 | A * | 3/1982 | Morin | ..... | 403/133 |
| 4,357,137 | A * | 11/1982 | Brown | ..... | 464/159 |
| 5,716,279 | A * | 2/1998 | Ham et al. | ..... | 464/159 |
| 6,902,344 | B2 * | 6/2005 | Raak et al. | ..... | 403/135 |
| 7,153,214 | B2 * | 12/2006 | Delaney et al. | ..... | 464/159 |
| 2010/0294092 | A1 * | 11/2010 | Hu | ..... | 81/450 |

* cited by examiner

*Primary Examiner* — Hadi Shakeri

(57) ABSTRACT

A two-section tool joint comprises a first rod, an engaging element, a second rod and a limiting element. The two-section tool joint utilizes an elastic engaging structure to obtain an engaging effect during a multi-angle screwing/unscrewing operation, meanwhile, the tool joint can be fixed stably, avoiding the retraction of the tool joint and reducing the difficulty and inconvenience of the screwing/unscrewing operation.

2 Claims, 11 Drawing Sheets

TWO-SECTION TOOL JOINT

BACKGROUND OF THE INVENTION

1. Field of the Invention

The present invention relates to a tool joint; and more particularly to a two-section tool joint.

2. Description of the Prior Art

In order to make tools applicable to various locking elements and have various working angles, the tools can be equipped with a tool joint.

Referring to FIG. 1, a first conventional tool joint disclosed in Taiwan Patent No. 097208543 essentially comprises a first rod 11 and a second rod 12. A polygonal ball 111 of the first rod 11 is restricted in a receiving groove 121, so that the first rod 11 can be adjusted to a predetermined angle with respect to the second rod 12. Between the receiving groove 121 and the polygonal ball 111 is disposed an elastic element 13 for elastically pressing against the polygonal ball 111 to maintain the first rod 11 and the second rod 12 at the predetermined angle after adjustment. However, the angle between the above first and second rods 11, 12 may change at any moment when the above tool joint is used in a screwing/unscrewing operation requiring no angular adjustment, thus causing much inconvenience and difficulty.

Referring to FIG. 2, a second conventional tool joint disclosed in Taiwan Patent No. 097207779 comprises a first rod 21 and a second rod 22 which are fixedly connected together by inserting a fixed end 211 of the first rod 21 into an inner groove 221 of the second rod 22. Therefore, the second conventional tool joint is applicable to the screwing/unscrewing operation which requires no angular adjustment. When the second conventional tool joint is used in a screwing/unscrewing operation requiring angular adjustment, the first rod 21 will be pulled to make the fixed end 211 of the first rod 21 disengage from the inner groove 221 of the second rod 22, so that the first rod 21 can be adjusted to a predetermined angle with respect to the second rod 22. However, after the first rod 21 is pulled toward an opening of the receiving groove 222 of the second rod 22, since there is no corresponding fixing structure, the first rod 21 will retract when the above conventional tool joint is used in the screwing/unscrewing operation requiring angular adjustment, thus causing much difficulty and inconvenience.

Referring to FIG. 3, a third conventional tool joint disclosed in Taiwan Patent No. 097203831 utilizes an annular protrusion 311 of a rod 31 to abut against an annular flange 321 of a holding seat 32 to fixedly connect the rod 31 and the holding seat 32 together, so that it can be applied in the screwing/unscrewing operation requiring no angular adjustment. When the rod 31 and the holding seat 32 are used in the screwing/unscrewing operation requiring angular adjustment, the rod 31 can be rotated relative to the holding seat 32 within a predetermined range after being pulled up slightly from the holding seat 32. However, the connecting end 312 of the rod 31 is restricted in the groove 322 of the holding seat 32 by means of an elastic element 33 cooperating with an engaging element 34. The working direction of the elastic element 33 and the engaging element 34 is different from the pulling direction of the rod 31 in the holding seat 32, namely, one is longitudinal, and the other is transverse. Therefore, after the rod 31 is pulled toward an opening of the groove 322 of the holding seat 32, the rod 31 will retract, thus causing much difficulty and inconvenience in the screwing/unscrewing operation requiring angular adjustment.

The present invention has arisen to mitigate and/or obviate the afore-described disadvantages.

SUMMARY OF THE INVENTION

The primary objective of the present invention is to provide a two-section tool joint which utilizes an elastic engaging structure to obtain an engaging effect and be fixed stably during a multi-angle screwing/unscrewing operation, avoiding the retraction of the tool joint and reducing the difficulty and the inconvenience of the screwing/unscrewing operation.

Hence, in order to achieve the above objective, a two-section tool joint in accordance with the present invention comprises a first rod, an engaging element, a second rod and a limiting element. The first rod includes a receiving groove in one end thereof, on an inner surface of the receiving groove are equidistantly provided six engaging protrusions, between each two neighboring engaging protrusions is defined an engaging groove. The engaging element includes a bottom and six support arms that are equidistantly arranged around a circumference of the bottom, each of the six support arms includes a first inwards-bent engaging portion and a second outwards-bent engaging portion connected to the first engaging portion, the first and the second engaging portions are allowed to restore to their original shapes after being deformed under pressure. The engaging element is disposed in the receiving groove of the first rod, and the bottom of the engaging element abuts against a bottom surface of the receiving groove. The support arms are located in the respective engaging grooves. The second rod includes a driving portion and a hexagonal ball along an axis thereof, the hexagonal ball includes six upper abutting surfaces and six lower abutting surfaces that are arranged around the axis, the respective lower abutting surfaces are located farther from the driving portion than the upper abutting surface, and the hexagonal ball is movably assembled in the receiving groove of the first rod. When the second rod is pushed back into the first rod to a retracted position, the respective first engaging portions of the engaging element will be pressed against the respective upper abutting surfaces of the hexagonal ball to hold the hexagonal ball between the bottom surface of the receiving groove and the first engaging portions, and when the second rod is pulled outwards relative to the first rod to an outward-extended position, the respective second engaging portions of the engaging element will be pressed against the lower abutting surfaces of the hexagonal ball to hold the hexagonal ball between the second engaging portions and an opening of the receiving groove. The limiting element is disposed at the opening of the receiving groove of the first rod for preventing the hexagonal ball from disengaging from the receiving groove.

DETAILED DESCRIPTION OF THE PREFERRED EMBODIMENTS

Figure 1:
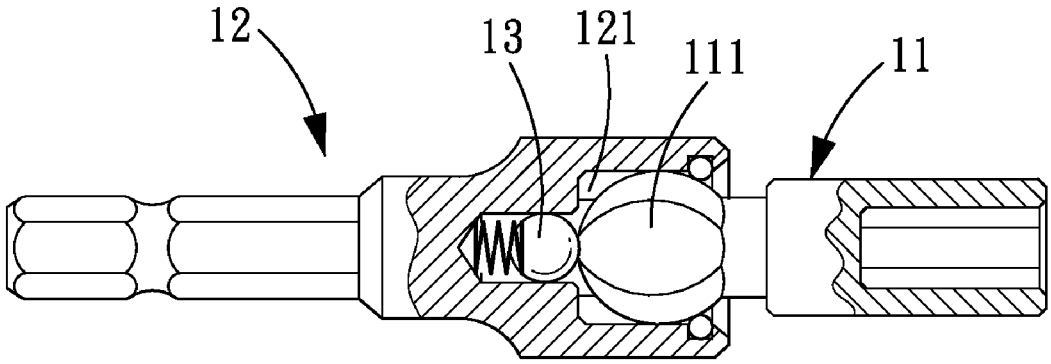
FIG. 1 PRIOR ART
FIG. 1 is a cross-sectional view of a first conventional tool joint disclosed by Taiwan Patent No. 097208543.
Figure 2:
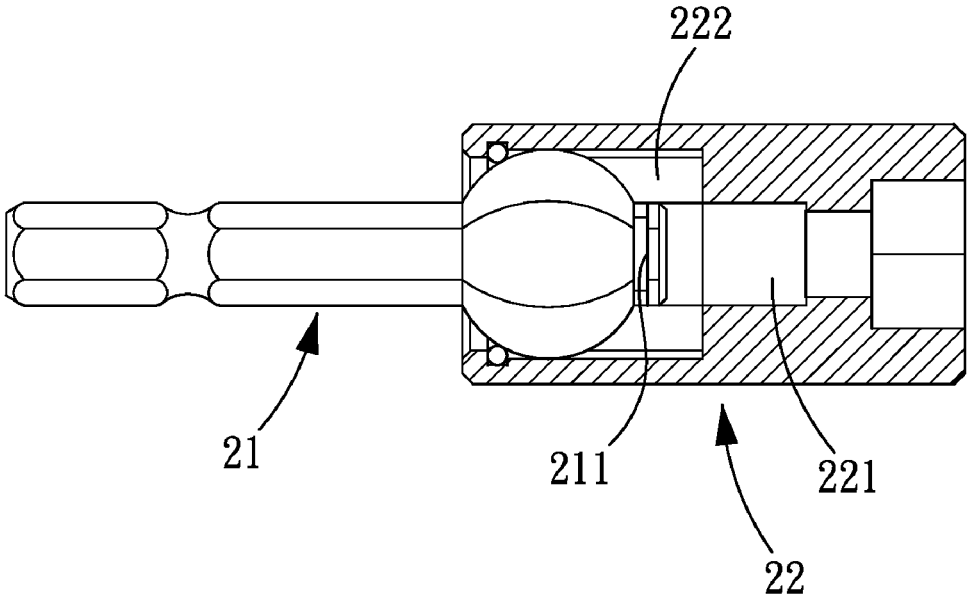
FIG. 2 PRIOR ART
FIG. 2 is a cross-sectional view of a second conventional tool joint disclosed by Taiwan Patent No. 097207779.
Figure 3:
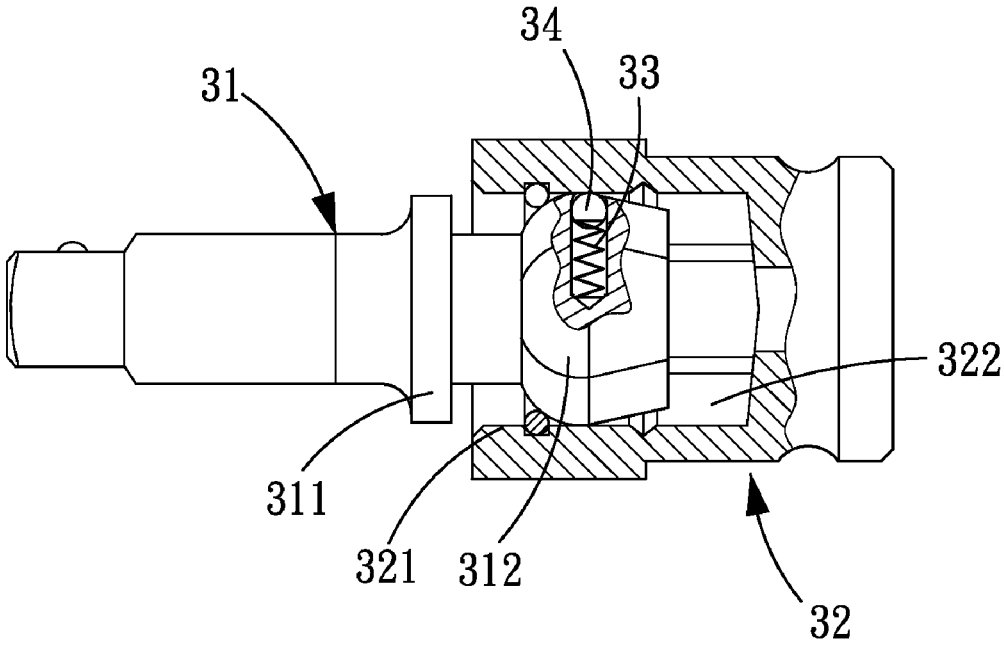
FIG. 3 PRIOR ART
FIG. 3 is a cross-sectional view of a third conventional tool joint disclosed by Taiwan Patent No. 097203831.
Figure 4:
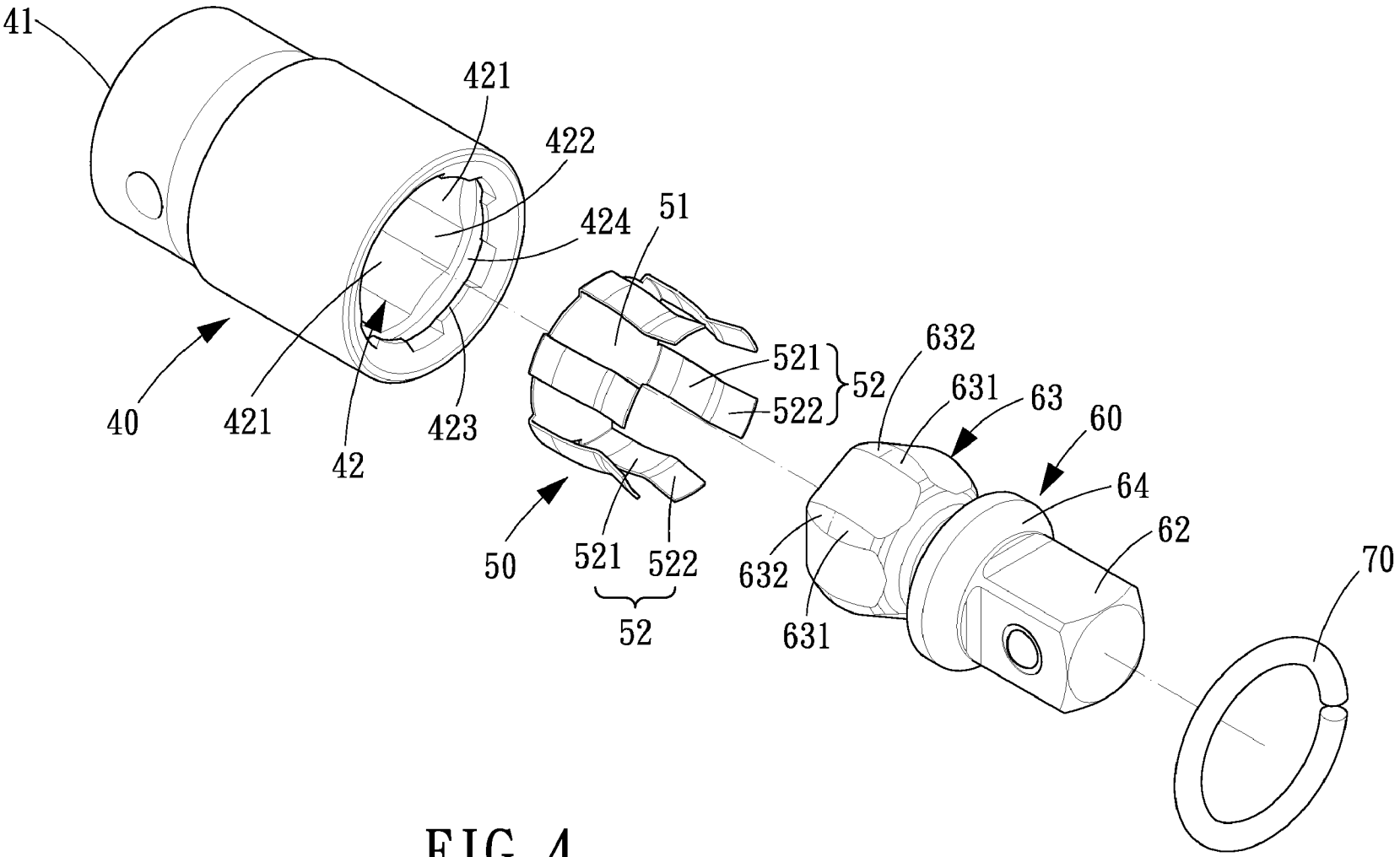
FIG. 4 is an exploded view of a two-section tool joint in accordance with the present invention.
Figure 5:
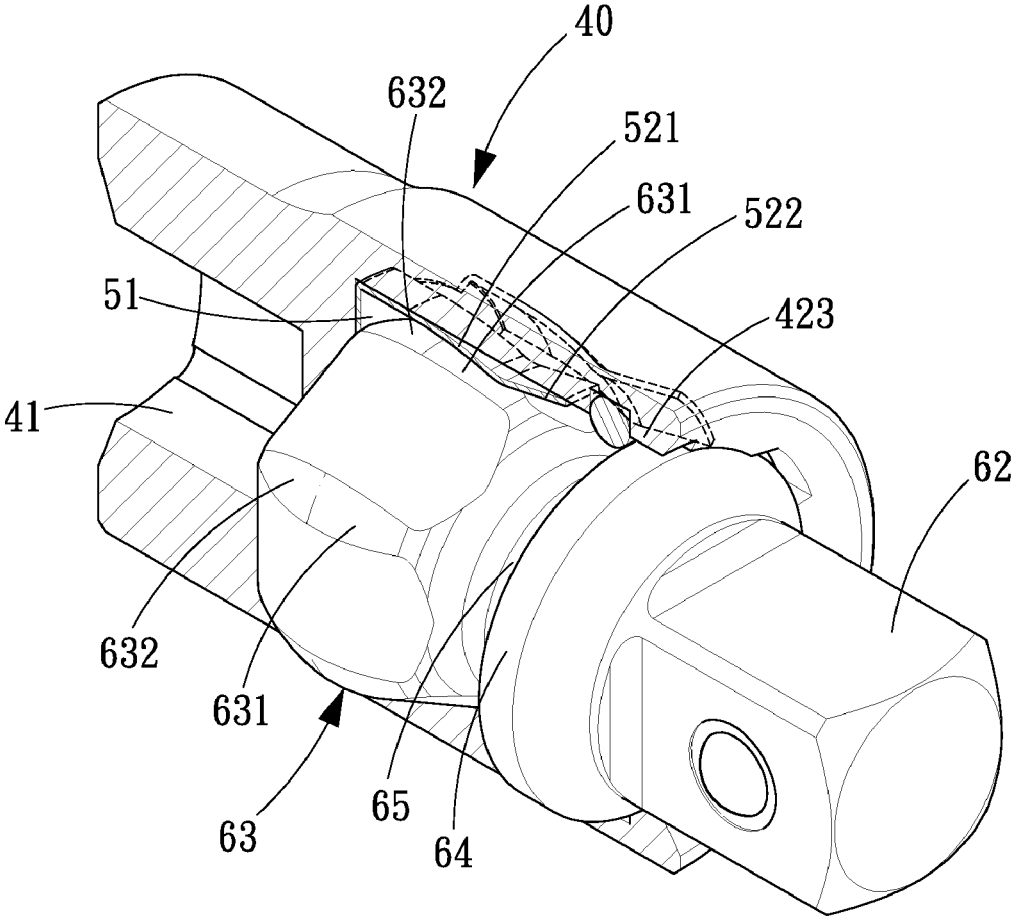
FIG. 5 is a perspective cross-sectional view of the two-section tool joint in accordance with the present invention.

The present invention will be clearer from the following description when viewed together with the accompanying drawings, which show, for purpose of illustrations only, the preferred embodiment in accordance with the present invention.

Referring to FIGS. 4-7, a two-section tool joint in accordance with a preferred embodiment of the present invention essentially comprises a first rod 40, an engaging element 50, a second rod 60 and a limiting element 70.

The first rod 40 includes a connecting portion 41 at one end thereof for connecting with a driving tool. The other end of the first rod 40 is defined with a receiving groove 42, and on an inner surface of the receiving groove 42 are equidistantly provided six engaging protrusions 421. Between each two neighboring engaging protrusions 421 is defined an engaging groove 422. The inner surface of the receiving groove 42 is further provided with an annular flange 423 and an annular groove 424 which are located at an opening of the receiving groove 42.

The engaging element 50 includes a bottom 51 and six support arms 52 that are equidistantly arranged around the circumference of bottom 51 and extend in the same direction. Each of the support arms 52 includes a first inwards-bent engaging portion 521 and a second outwards-bent engaging portion 522 connected to the first engaging portion 521. The first and the second engaging portions 521, 522 can restore to their original shapes after being deformed under pressure. The engaging element 50 is disposed in the receiving groove 42 of the first rod 40 in such a manner that the bottom 51 abuts against the bottom surface of the receiving groove 42, the respective support arms 52 are located in the engaging grooves 422, and the support arms 52 abut against the inner surface of the receiving groove 42. The first and second engaging portions 521, 522 define a compression space A with respect to the inner surface of the receiving groove 42. When the first and the second engaging portions 521, 522 are deformed under pressure, the compression space A will disappear, and when the first and the second engaging portions 521, 522 restore to their original shapes, the compression space A is formed again.

The second rod 60 includes a driving portion 62 and a hexagonal ball 63 along an axis 61 thereof. Between the driving portion 62 and the hexagonal ball 63 are provided an annular protrusion 64 and a neck portion 65. The driving portion 62 is used to engage with and rotate a corresponding a threaded fastener. The hexagonal ball 63 includes six upper abutting surfaces 631 and six lower abutting surfaces 632 that are arranged around the axis 61. The upper abutting surfaces 631 are connected to the respective lower abutting surfaces 632, and the upper and the lower abutting surfaces 631, 632 are formed along the axis 61. Further, the respective lower abutting surfaces 632 are located farther from the driving portion 62 than the upper abutting surface 631. The upper abutting surfaces 631 taper towards the driving portion 62 while the lower abutting surfaces 632 taper toward the direction opposite the driving portion 62. The hexagonal ball 63 can be movably assembled in the receiving groove 42 of the first rod 40. When the second rod 60 is pushed back into the first rod 40 to a retracted position, the respective first engaging portions 521 of the engaging element 50 will be pressed against the respective upper abutting surfaces 631 of the hexagonal ball 63 to hold the hexagonal ball 63 between the bottom surface of the receiving groove 42 and the first engaging portions 521. When the second rod 60 is pulled outwards relative to the first rod 40 to an outward-extended position, the respective second engaging portions 522 of the engaging element 50 will be pressed against the lower abutting surfaces 632 of the hexagonal ball 63 to hold the hexagonal ball 63 between the respective second engaging portions 522 and the opening of the receiving groove 42.

Moreover, when the second rod 60 is pushed back into the first rod 40 to the retracted position, the annular protrusion 64 of the second rod 60 will abut against the annular flange 423 of the first rod 40, so that the angle between the first and the second rods 40, 60 is locked and not adjustable.

The limiting element 70 is annular and disposed in the annular groove 424 of the receiving groove 42 and engaged on the neck portion 65 of the second rod 60. The inner diameter of the limiting element 70 is smaller than the outer diameter of the hexagonal ball of the second rod 60 for preventing the hexagonal ball 63 from disengaging from the receiving groove 42.

The aforementioned is the summary of the positional and structural relationship of the respective components of the preferred embodiment in accordance with the present invention.

Figure 6:
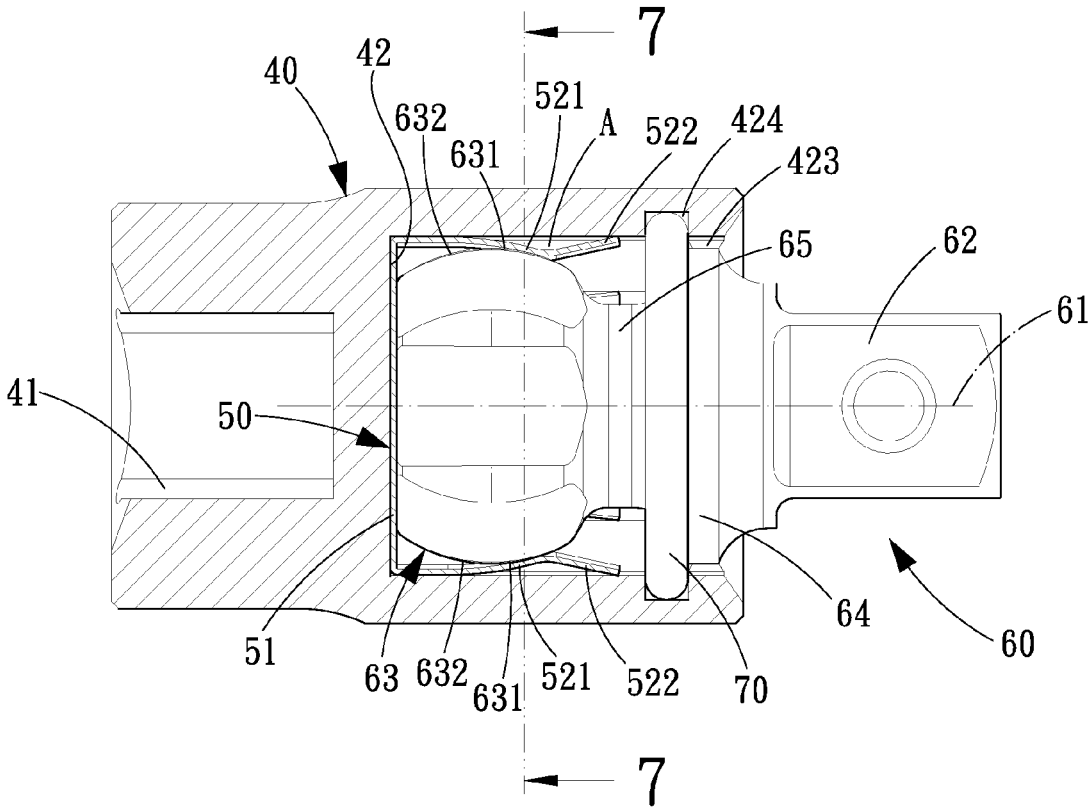
FIG. 6 is a cross-sectional view of the two-section tool joint in accordance with the present invention.
Figure 7:
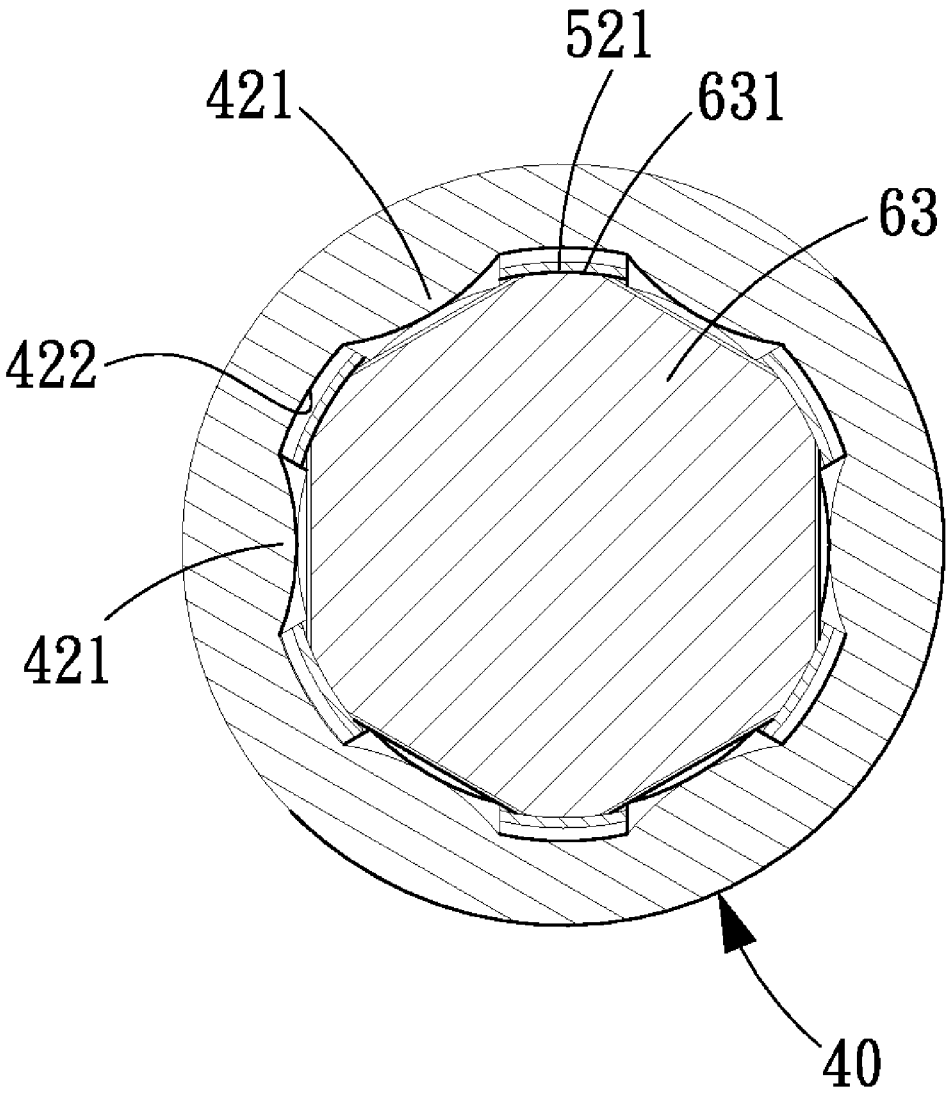
FIG. 7 is a cross sectional view of the two-section tool joint in accordance with the present invention along line 7-7 of FIG. 6.

For a better understanding of the present invention, its operation and function, reference should be made to FIG. 6: when the second rod 60 is pushed back into the first rod 40 to the retracted position, (namely, the hexagonal ball 63 is pushed close to the bottom surface of the receiving groove 42), the engaging element 50 will hold the hexagonal ball 63 of the second rod 60 between the bottom surface of the receiving groove 42 and the respective first engaging portions 521, meanwhile, the annular protrusion 64 of the second rod 60 will abut against the annular flange 423 of the first rod 40 to lock the angle between the first and the second rods 40, 60. Therefore, the present invention can make the screwing/unscrewing operation requiring no angular adjustment smooth.

Figure 8:
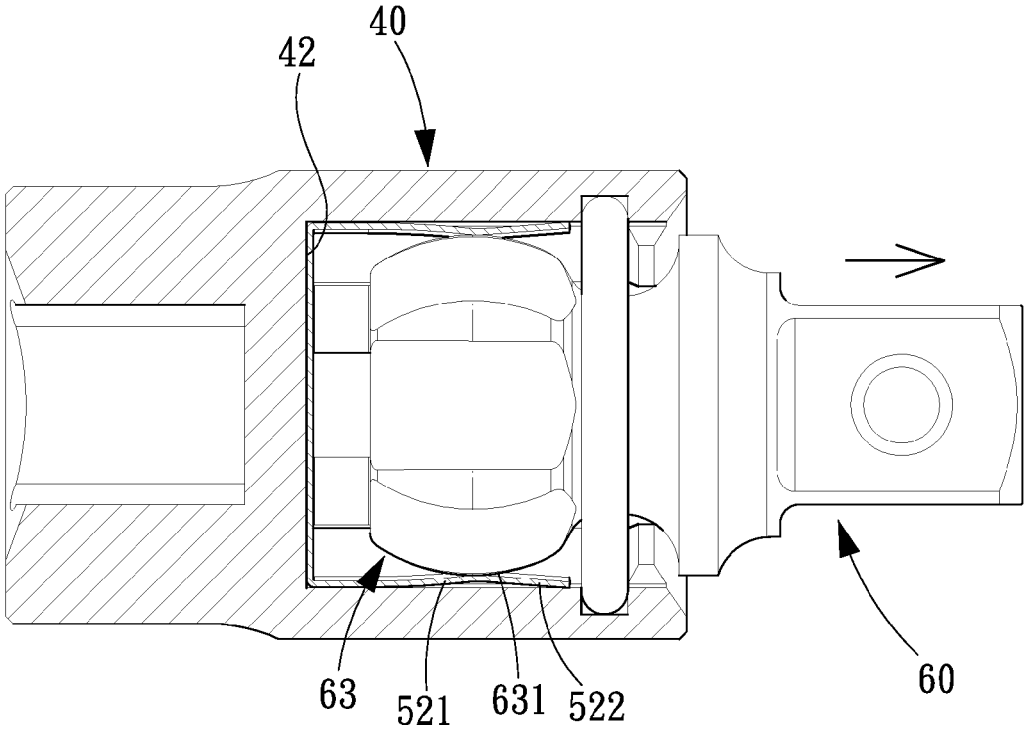
FIG. 8 is an operational view of the present invention, showing the second rod is pulled.

As shown in FIG. 8, when the second rod 60 is pulled outwards relative to the first rod 40 to the outward-extended position (namely, the hexagonal ball 63 is pulled outwards away from the bottom surface of the receiving groove 42), first, since the outer diameter of the middle portion of the hexagonal ball 63 is the greatest, during the disengaging process of the upper abutting surfaces 631 of the hexagonal ball 63 and the first engaging portions 521, the inwards-bent first engaging portions 521 will be pressed by the middle portion of the hexagonal ball 63 to deform, in addition, the second engaging portions 522 which are connected with the first engaging portions 521 will be consequently deformed, at this moment, the compression space A defined by the first, the second engaging portions 521, 522 with respect to the inner surface of the receiving groove 42 will disappear.

Figure 9:
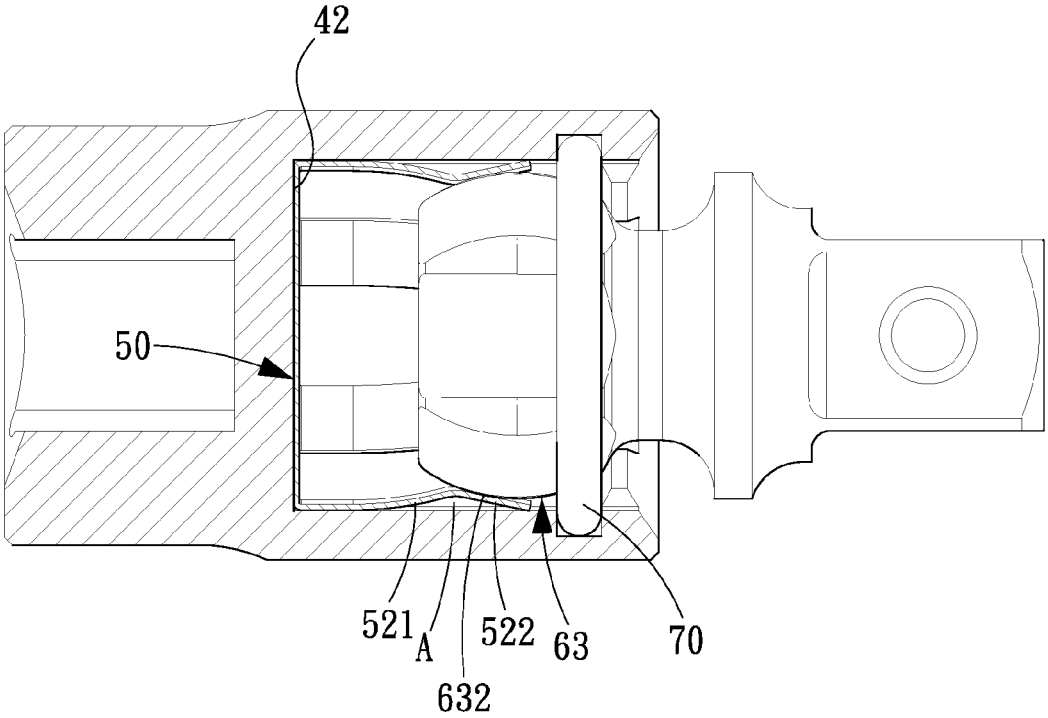
FIG. 9 is an operational view of the present invention, showing the second rod extends from the first rod.

As shown in FIG. 9, when the middle portion of the hexagonal ball 63 passes through the joints of the first and the second engaging portions 521, 522, the second engaging portions 522 of the engaging element 50 will not be pressed any longer and can restore to their original shapes, namely, restore to the outwards-bent state, at this moment, the compression space A defined by the first, the second engaging portions 521, 522 with respect to the inner surface of the receiving groove 42 will be formed again.

Finally, the second engaging portions 522 which have restored to their original shapes will be pressed against the low abutting surfaces 632 of the hexagonal ball 63 correspondingly, so that the hexagonal ball 63 can be held between the respective second engaging portions 522 and the limiting element 70.

Figure 10:
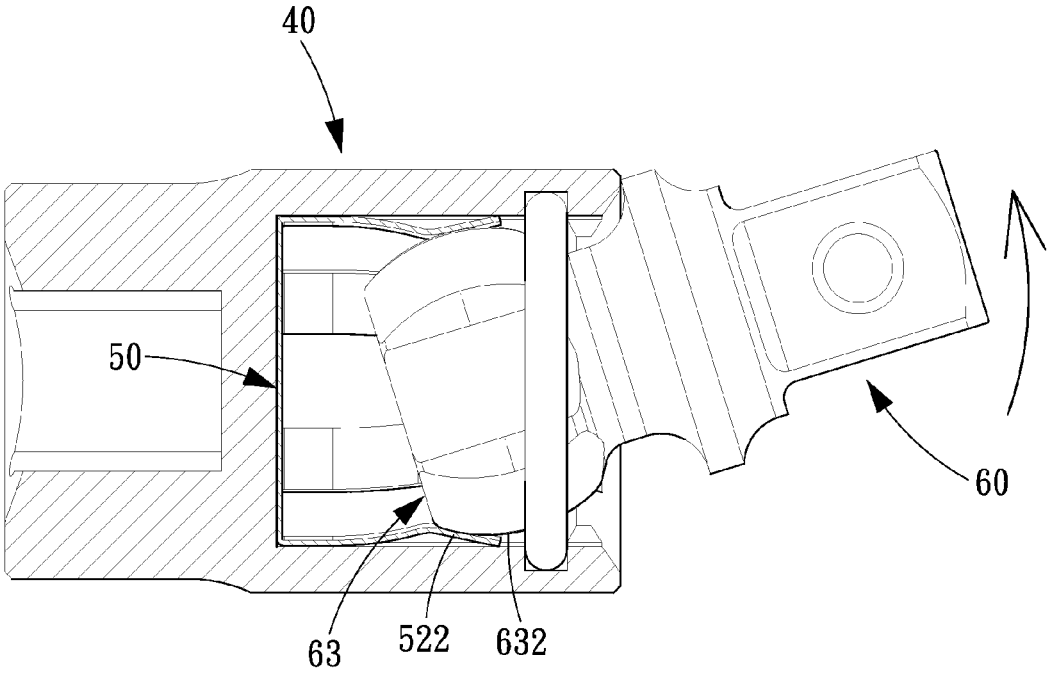
FIG. 10 is an operational view of the present invention, showing the second rod is adjusted upwards.
Figure 11:
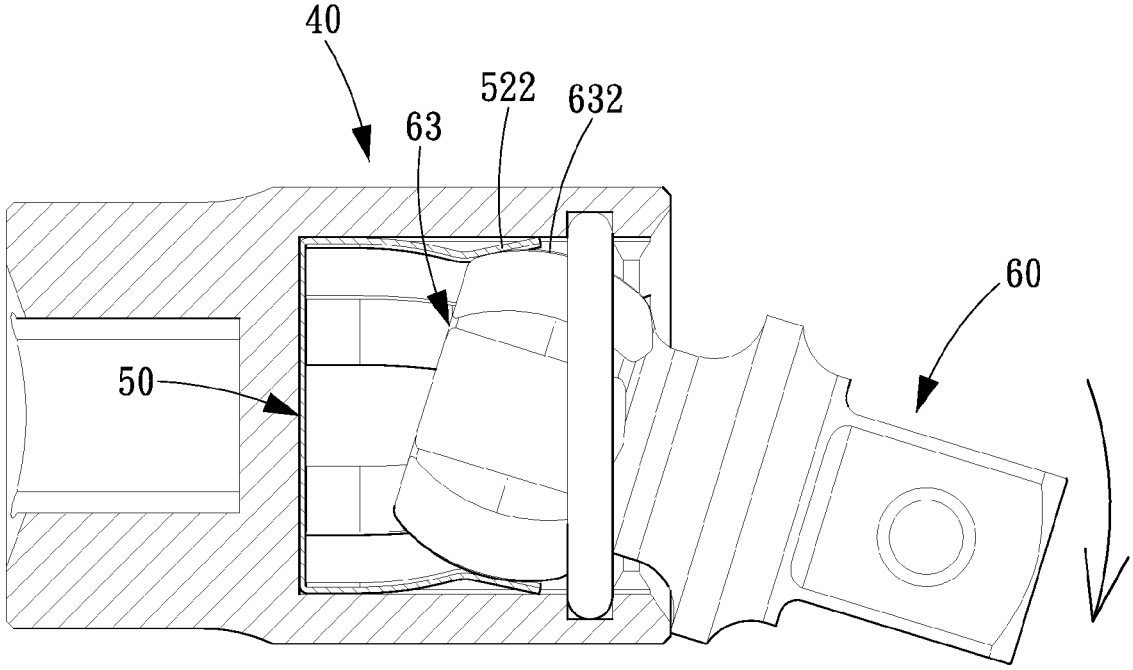
FIG. 11 is an operational view of the present invention, showing that the second rod is adjusted downwards.

Hence, as shown in FIGS. 10 and 11, when the second rod 60 is pulled outwards relative to the first rod 40 to the outward-extended position, the first rod 40 and the second rod 60 can be bent at multiple angles. No matter how the first and the second rods 40, 60 are bent, at least one of the second engaging portions 522 will be pressed against the lower abutting surfaces 632 of the hexagonal ball 63. Moreover, after the second engaging portions 522 are pressed against the lower abutting surfaces 632 of the hexagonal ball 63, the working direction is the same as the direction in which the first rod 40 and the second rod 60 retract toward or extend from each other, so that the tool joint of the present invention can be positioned stably in a multi-angle screwing/unscrewing operation, avoiding the retraction of the tool joint and reducing the difficulty and inconvenience of the screwing/unscrewing operation.

While we have shown and described various embodiments in accordance with the present invention, it is clear to those skilled in the art that further embodiments may be made without departing from the scope of the present invention.

What is claimed is:

1. A two-section tool joint comprising:

a first rod including a receiving groove in one end thereof, on an inner surface of the receiving groove being equidistantly provided six engaging protrusions, between each two neighboring engaging protrusions being defined an engaging groove;

a second rod received in the receiving groove of the first rod and including a driving portion and a hexagonal ball along an axis thereof;

a limiting element being disposed at an opening of the receiving groove of the first rod for preventing the hexagonal ball from disengaging from the receiving groove;

an engaging element including a bottom and six support arms that are equidistantly arranged around a circumference of the bottom;

the engaging element being disposed in the receiving groove of the first rod, the bottom of the engaging element abutting against a bottom surface of the receiving groove, the support arms being located in the respective engaging grooves;

the engaging element being characterized in that: each of the six support arms including a first inwards-bent engaging portion and a second outwards-bent engaging portion the first and the second engaging portions being allowed to restore to their original shapes after being deformed under pressure; the hexagonal ball including six upper abutting surfaces and six lower abutting surfaces that are arranged around the axis, the respective lower abutting surfaces being located farther from the driving portion than the upper abutting surface, the hexagonal ball being disposed in the receiving groove of the first rod and movable along the axis, when the second rod is pushed back into the first rod to a retracted position, the respective first engaging portions of the engaging element will be pressed against the respective upper abutting surfaces of the hexagonal ball to hold the hexagonal ball between the bottom surface of the receiving groove and the first engaging portions, and when the second rod is pulled outwards relative to the first rod to an outward-extended position the respective second engaging portions of the engaging element will be pressed against the lower abutting surfaces of the hexagonal ball to hold the hexagonal ball between the second engaging portions and the opening of the receiving groove;

the first and the second engaging portions of the engaging element define a compression space with respect to the inner surface of the receiving groove, when the first and the second engaging portions are deformed under pressure, the compression space will disappear, and when the first and the second engaging portions restore to their original shapes, the compression space will be formed.

2. The two-section tool joint as claimed in claim 1, wherein the upper abutting surfaces of the second rod are connected to the respective lower abutting surfaces of the second rod, and the upper and the lower abutting surfaces of the second rod are formed along the axis of the second rod, the upper abutting surfaces taper towards the driving portion while the lower abutting surfaces taper toward a direction opposite the driving portion.

* * * * *